US008839751B2

(12) United States Patent
Dietz et al.

(10) Patent No.: US 8,839,751 B2
(45) Date of Patent: Sep. 23, 2014

(54) INTERNAL COMBUSTION ENGINE HAVING A DEVICE FOR CHANGING THE RELATIVE ANGULAR POSITION OF A CAMSHAFT WITH RESPECT TO A CRANKSHAFT

(75) Inventors: Joachim Dietz, Frensdorf (DE); Rudiger Herzog, Hirschaid (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 6 days.

(21) Appl. No.: 13/635,487

(22) PCT Filed: Feb. 8, 2011

(86) PCT No.: PCT/EP2011/051805

§ 371 (c)(1), (2), (4) Date: Sep. 17, 2012

(87) PCT Pub. No.: WO2011/117018

PCT Pub. Date: Sep. 29, 2011

(65) Prior Publication Data

US 2013/0000580 A1 Jan. 3, 2013

(30) Foreign Application Priority Data

Mar. 24, 2010 (DE) ..... 10 2010 012 481

(51) Int. Cl.
*F01L 1/34* (2006.01)
*F01L 1/344* (2006.01)

(52) U.S. Cl.
CPC ..... *F01L 1/3442* (2013.01); *F01L 2001/34436* (2013.01); *F01L 1/344* (2013.01)
USPC ..... 123/90.17; 123/90.15; 464/160

(58) Field of Classification Search
CPC ..... F01L 1/3442; F01L 2001/34423
USPC ..... 123/90.17, 90.15; 464/160
See application file for complete search history.

(56) References Cited

U.S. PATENT DOCUMENTS

| | | | | |
|---|---|---|---|---|
| 5,931,126 | A | 8/1999 | Eguchi et al. | |
| 6,722,330 | B2 * | 4/2004 | Pierik et al. | 123/90.17 |
| 2003/0217719 | A1 | 11/2003 | Pierik et al. | |

FOREIGN PATENT DOCUMENTS

| | | |
|---|---|---|
| DE | 19829049 | 1/1999 |
| JP | 55-12180 | 1/1980 |
| WO | 2006119737 | 11/2006 |

* cited by examiner

*Primary Examiner* — Ching Chang
(74) *Attorney, Agent, or Firm* — Volpe and Koenig, P.C.

(57) ABSTRACT

An internal combustion engine (1) having a device (2) for changing the relative angular position of a camshaft (3) with respect to a crankshaft of the internal combustion engine, wherein the device (2) includes a drive element (4) driven by the crankshaft and a housing element (5). The drive element (4) together with the housing element (5) rotates about an axis (a) during operation of the internal combustion engine and the device (2) is at least partially surrounded by a casing (6) of the internal combustion engine (1). In order to improve the oil exchange in the housing bell of the internal combustion engine, and to prevent deposition of particles in the housing bell, the housing element (5) is provided with at least one fluid-conveying element (7), wherein the fluid-conveying element (7) is intended and suitable for conveying fluid.

10 Claims, 5 Drawing Sheets

INTERNAL COMBUSTION ENGINE HAVING A DEVICE FOR CHANGING THE RELATIVE ANGULAR POSITION OF A CAMSHAFT WITH RESPECT TO A CRANKSHAFT

FIELD OF THE INVENTION

The invention relates to an internal combustion engine having a device for changing the relative angular position of a camshaft with respect to a crankshaft of the internal combustion engine, wherein the device comprises a drive element which is driven by the crankshaft and has a housing element, wherein, during the operation of the internal combustion engine, the drive element together with the housing element rotates about an axis, and wherein the device is at least partially surrounded by a housing of the internal combustion engine.

BACKGROUND

Camshaft adjustment devices, in particular those which operate hydraulically, are generally used in internal combustion engines. Examples thereof are disclosed by DE 198 29 049 A1 and U.S. Pat. No. 5,931,126. If the camshaft adjuster operates hydraulically—which is typical—it has an impeller in which blades are formed or arranged. The blades are located in hydraulic chambers which are incorporated in an external rotor. By the particular side of the hydraulic chambers being correspondingly acted upon by hydraulic fluid, the internal rotor (connected to the camshaft) can be adjusted relative to the external rotor between an "early stop" and a "late stop". In this case, the flow of hydraulic oil is controlled by an electrically activated directional control valve. The rotational movement of the crankshaft is generally transmitted to the external rotor via a gearwheel to which the external rotor is connected for conjoint rotation.

The camshaft adjuster therefore has a drive element which is driven by the crankshaft and is connected to a housing element in which the adjustment mechanism is arranged. During the operation of the internal combustion engine, the drive element, which is frequently driven by a chain or by a drive gearwheel, together with the housing element, rotate about an axis at the rotational speed of the camshaft. In this case, the camshaft adjuster is, however, partially surrounded by a housing (or by a housing bell) of the internal combustion engine.

In the housing bell, oil is poured to a desired oil level at which the camshaft adjuster runs. At too low a circulation of the oil, dirt particles are disadvantageously deposited in the housing bell, which may even result in failure of the camshaft adjuster.

SUMMARY

The present invention is based on the object of developing an internal combustion engine of the type mentioned at the beginning in such a manner that the oil exchange in the housing bell of the internal combustion engine is improved. It is therefore intended to be possible to prevent, or at any rate to minimize, the deposition of particles in the housing bell.

The achievement of this object by the invention is characterized in that the housing element is provided with at least one fluid-conveying element, wherein the fluid-conveying element is intended and is suitable for conveying (hydraulic) fluid.

The housing element is preferably provided with a multiplicity of fluid-conveying elements. In this case, the fluid-conveying elements are advantageously arranged distributed equidistantly around the circumference of the housing element.

The at least one fluid-conveying element is preferably designed as a web-, blade- or rib-like structure which is arranged on the outer surface of the housing element.

The housing element and the fluid-conveying elements are preferably designed as a single piece, in particular as a cast part.

The housing element preferably has a cylindrical section, wherein the fluid-conveying elements are arranged thereon. According to one embodiment of the invention, the fluid-conveying elements extend in the direction of the axis.

However, it is also possible for the fluid-conveying elements to extend at an angle with respect to the direction of the axis, wherein the angle is preferably between 10° and 30°.

An annular gap is preferably formed between the housing element and the housing of the internal combustion engine, wherein the fluid-conveying elements are designed and arranged for conveying fluid (oil) through the annular gap. A fluid outflow opening can be adjacent to the annular gap, wherein the fluid-conveying elements are designed and arranged for conveying fluid to the fluid outflow opening.

The proposal according to the invention is therefore focused on a special configuration of the external housing of the camshaft adjuster which is arranged in a housing bell of the internal combustion engine.

For this purpose, the external housing (housing element) of the camshaft adjuster, which is located in the housing (housing bell) of the internal combustion engine and partially runs in oil here, is provided with ribs or blades with which the oil can be conveyed.

During the operation of the internal combustion engine, the camshaft adjuster, i.e. including the external housing thereof, runs about the axis thereof at the rotational speed of the camshaft. Consequently, the ribs or blades move the oil located in the housing bell.

The continuous movement of the oil makes it possible to prevent dirt particles which are located in the oil from being permanently deposited in the housing bell.

The shape of the ribs or blades may be configured such that the oil is contained in a specific manner to an oil outlet bore in the housing bell or in the cylinder head of the internal combustion engine, and therefore the oil flows more rapidly out of the housing bell or oil is exchanged more rapidly.

It is also possible in this case for the oil not only to be conveyed specifically in one direction, but also for said oil to be pumped off according to the principle of a centrifugal pump by means of the rotating, ribbed camshaft adjuster or the housing element thereof on the basis of centrifugal forces.

BRIEF DESCRIPTION OF THE DRAWINGS

Exemplary embodiments of the invention are illustrated in the drawings, in which.

DETAILED DESCRIPTION OF THE PREFERRED EMBODIMENTS

Figure 1:
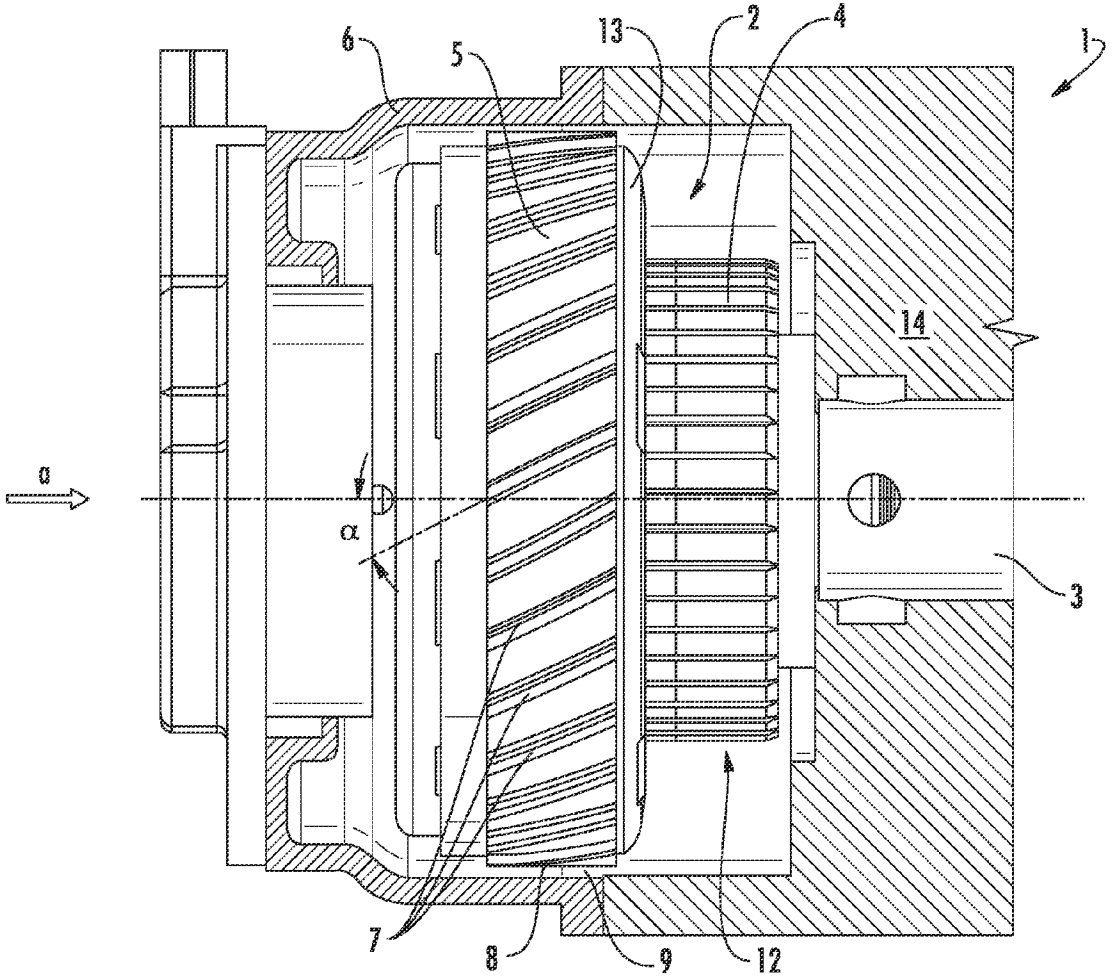
FIG. 1 shows a sectionally illustrated side view of part of an internal combustion engine with a camshaft adjuster and a housing (housing bell) which surrounds the camshaft adjuster.

FIG. 1 outlines part of an internal combustion engine 1, specifically a part of the drive of a camshaft 3 which is driven by a camshaft adjuster 2. The camshaft adjuster serves to change the relative angular position of the camshaft 2 with respect to the crankshaft (not illustrated) of the internal combustion engine 1.

The camshaft adjuster 2 has a drive element 4, the outer circumference of which has a toothing 12 via which a connection for conjoint rotation to the crankshaft (not illustrated) of the internal combustion engine is produced. The drive element 4 has a flange-like sealing cover 13 with which said drive element is connected to the further structural elements of the camshaft adjuster 2, namely to a housing element 5 in which the relevant components of the camshaft adjuster 2 are accommodated.

The camshaft adjuster 2 is of the typical construction, and therefore reference may be made with regard to details, for example, to U.S. Pat. No. 5,931,126 mentioned above.

The camshaft adjuster 2 is mounted in a section of the internal combustion engine 1, i.e. the camshaft 3 is mounted in the internal combustion engine 1, and the drive element 4 of the camshaft adjuster 2 is mounted in turn on said camshaft. At the location denoted by the reference number 14 in the internal combustion engine, a camshaft bearing is formed for the camshaft 3, the camshaft bearing permitting the rotational mounting of the camshaft 3 in the engine 1.

The camshaft adjuster 2 is surrounded by a housing 6 which is bolted to the engine block and is referred to below as a housing bell. During the operation of the internal combustion engine, the camshaft adjuster 2 rotates about the axis a at the rotational speed of the camshaft. In this case, the rotationally symmetrical housing element 5 of the camshaft adjuster 2 is surrounded by the housing bell 6 in such a manner that there is an annular gap 9 between a cylindrical section 8 of the housing element 5 and the housing bell 6.

It is essential that the housing element 5 is provided with at least one fluid-conveying element 7, wherein the fluid-conveying element 7 is intended and is suitable for conveying (hydraulic) fluid. This means specifically, in the exemplary embodiment according to FIG. 1, that a number of rib-shaped fluid-conveying elements 7 are arranged uniformly over the circumference of the housing element 5 in the region of the cylindrical section 8.

Figure 2:
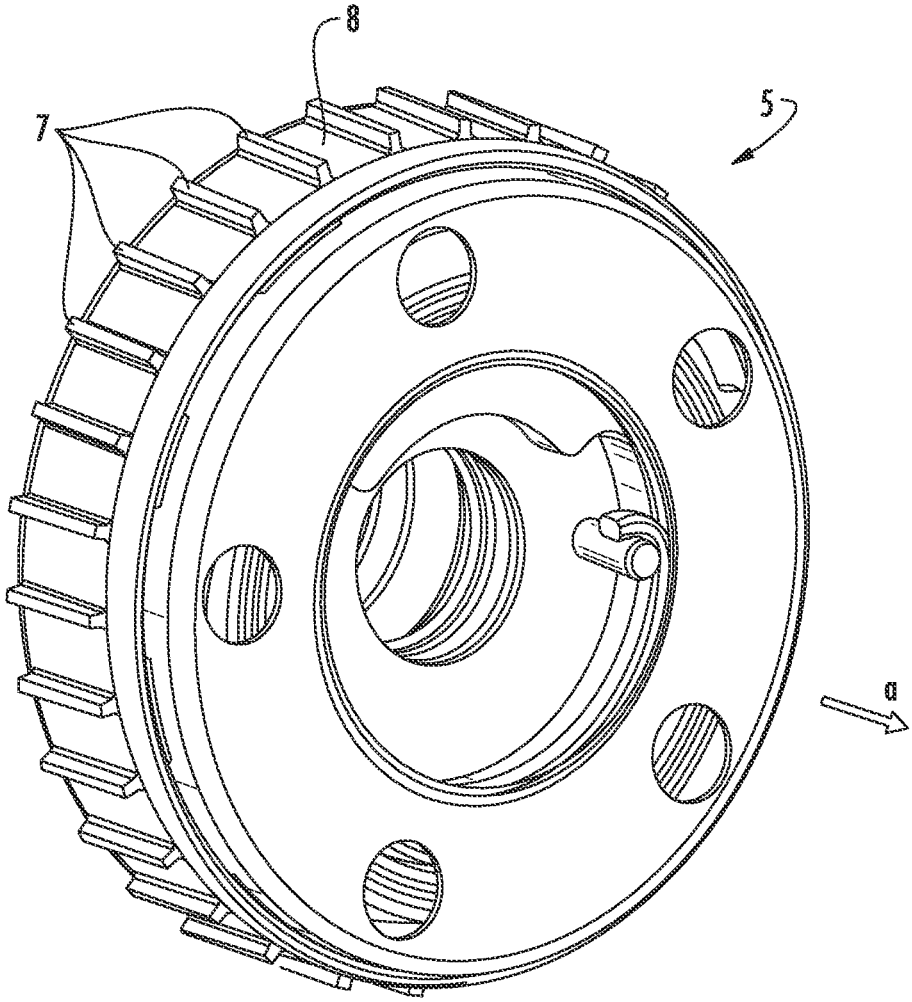
FIG. 2 shows, in a perspective view, the housing element of the camshaft adjuster without a drive element according to a first embodiment of the invention.
Figure 3:
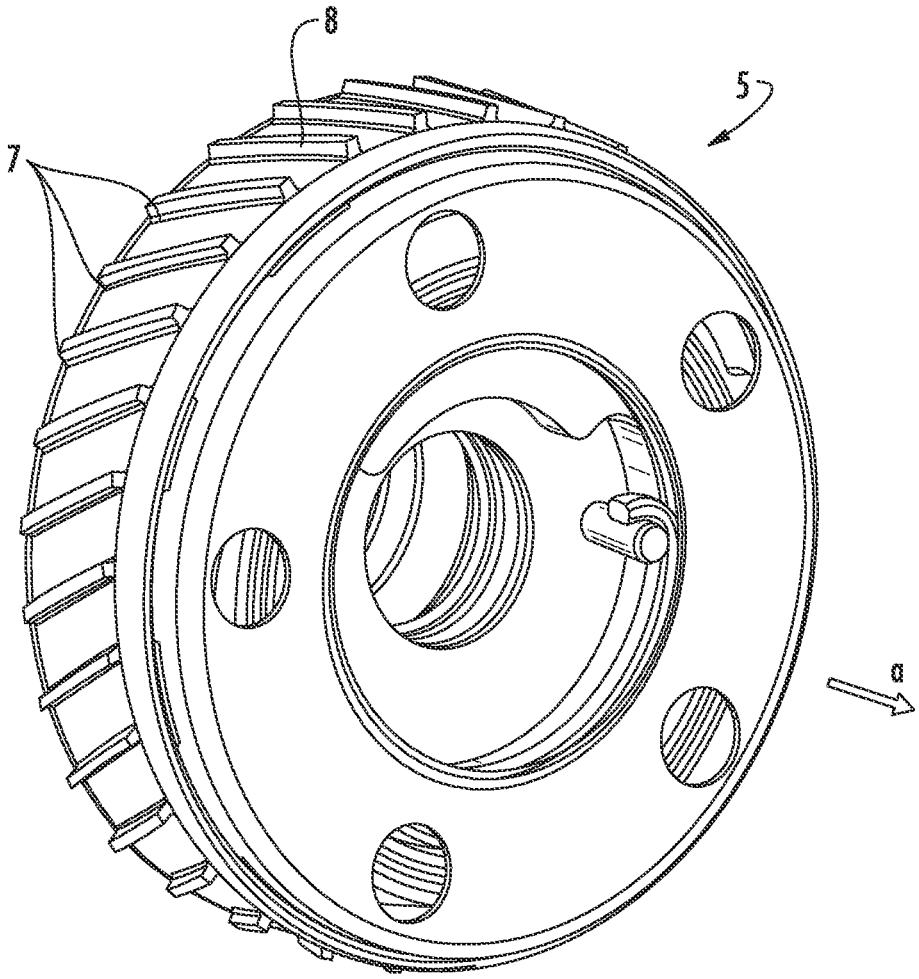
FIG. 3 shows, in a perspective view, the housing element of the camshaft adjuster without a drive element according to a second embodiment of the invention.

Possible embodiments of the housing element 5 of the camshaft adjuster 2 are illustrated in FIG. 2 and FIG. 3.

According to FIG. 2, the fluid-conveying elements 7, i.e. the ribs or webs, run in the axial direction a, thus enabling fluid conveying in the circumferential direction of the housing element 5 to be achieved.

In the case of the solution according to FIG. 3, the fluid-conveying elements 7 are arranged at an angle with respect to the axis a (the angle $\alpha$ is plotted in FIG. 1). Therefore, upon rotation of the housing element 5, fluid is not only conveyed in the circumferential direction but also in the axis direction a.

Figure 4:
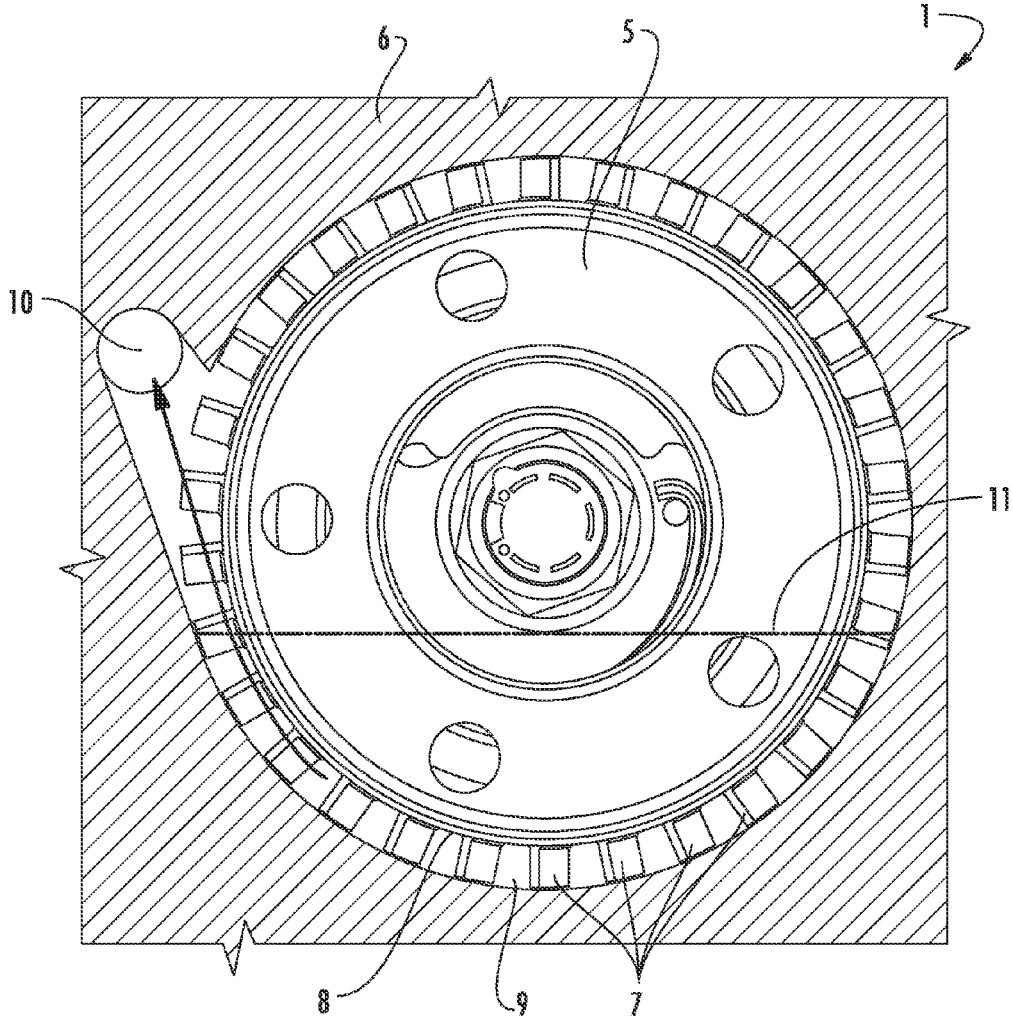
FIG. 4 shows a sectionally illustrated front view (as viewed in the direction of the axis) of part of the internal combustion engine with the housing element, which is surrounded by the housing bell, of the camshaft adjuster in a first embodiment.

FIG. 4 shows an embodiment of an internal combustion engine, in which the housing bell 6 surrounds the housing element 5 of the camshaft adjuster 2, wherein oil is poured up to an oil level 11 in the housing bell 6. During the operation of the internal combustion engine and therefore associated rotation of the housing element 5 (in the clockwise direction), oil is conveyed by the fluid-conveying element 7 in the arrow direction through the annular gap 9, as a result of which the oil passes to a fluid outflow opening 10. In the solution, the fluid outflow opening 10 is therefore located above the oil level 11. The rotating housing element 5 therefore operates in the manner of a centrifugal pump.

Figure 5:
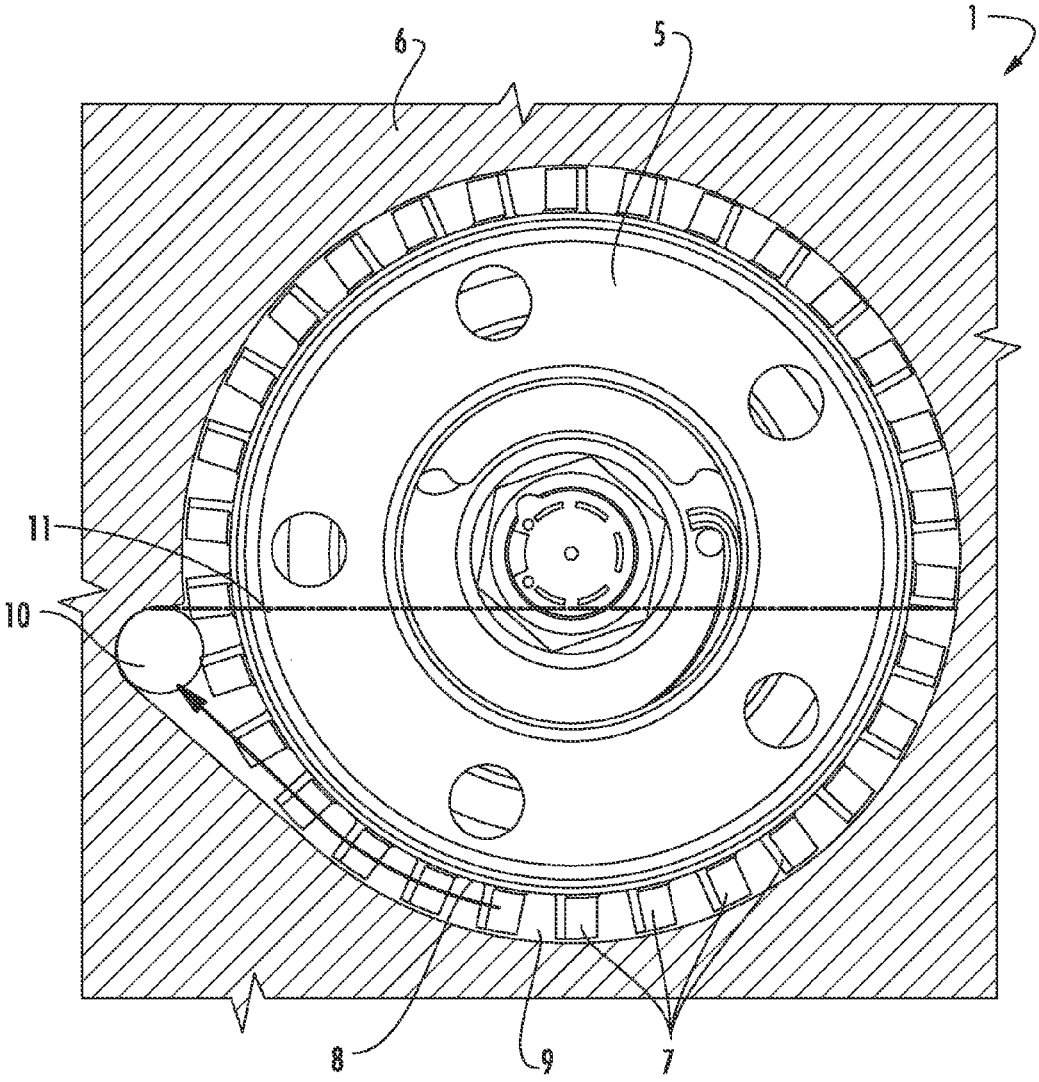
FIG. 5 shows, in the illustration according to FIG. 4, the part of the internal combustion engine in a second embodiment.

According to FIG. 5, provision may also be made for the fluid outflow opening 10 to be located below the oil level 11. However, the manner of operation described in conjunction with FIG. 4 remains the same.

The ribs 7 (fluid-conveying elements) which are arranged on the outer surface of the housing element 5 of the camshaft adjuster 2 therefore move the oil in the housing bell 6 during the operation of the internal combustion engine. This prevents dirt particles from being able to collect and be deposited in the housing bell.

The shape of the ribs 7 here may be selected in such a manner that the oil can be conveyed or pumped off in a specific manner in a desired direction. An arrangement of the ribs 7 at an angle $\alpha$ with respect to the axis a (see FIG. 1) can produce a desired conveying direction. For this purpose, the ribs 7 dip into the oil during the rotation of the camshaft adjuster 2.

The ribs 7 may be manufactured by sintering, casting, milling or deformation. Said ribs are preferably integrally formed at the same time as the casting of the housing element and are consequently then formed as a single piece with the housing element 5.

The ribs 7 may be located on all of the surfaces of the housing element 5 of the camshaft adjuster. In addition to the preferably provided cylindrical outer circumference 8 of the camshaft adjuster stator, in particular the spring cover, the front cover and the sealing cover of the camshaft adjuster are suitable for this purpose.

LIST OF REFERENCE SYMBOLS

1 Internal combustion engine
2 Device (camshaft adjuster)
3 Camshaft
4 Drive element
5 Housing element
6 Housing (housing bell)
7 Fluid-conveying element (rib, blade)
8 Cylindrical section
9 Annular gap
10 Fluid outflow opening
11 Oil level
12 Toothing
13 Sealing cover
14 Camshaft bearing
a Axis
$\alpha$ Angle

The invention claimed is:

1. An internal combustion engine having a device for changing a relative angular position of a camshaft with respect to a crankshaft of the internal combustion engine, the device comprising: a drive element which is mounted on the camshaft and is driven by the crankshaft and has a housing element, wherein, during operation of the internal combustion engine, the drive element together with the housing element rotates about an axis (a), and the device is at least partially surrounded by a housing of the internal combustion engine, the housing element includes at least one fluid-conveying element, and the fluid-conveying element is arranged on a circumference of the housing element and is adapted to convey fluid.

2. The internal combustion engine as claimed in claim 1, wherein the housing element includes a multiplicity of fluid-conveying elements.

3. The internal combustion engine as claimed in claim 2, wherein the fluid-conveying elements are arranged distributed equidistantly around the circumference of the housing element.

4. The internal combustion engine as claimed in claim 1, wherein the at least one fluid-conveying element has as a web-, blade- or rib-like structure which is arranged on an outer surface of the housing element.

5. The internal combustion engine as claimed in claim 1, wherein the housing element and the at least one fluid-conveying element are formed as a single piece.

6. The internal combustion engine as claimed in claim 1, wherein the housing element has a cylindrical section, and the at least one fluid-conveying element is arranged on the cylindrical section.

7. The internal combustion engine as claimed in claim 6, wherein the at least one fluid-conveying element extends in a direction of the axis (a).

8. The internal combustion engine as claimed in claim 6, wherein the at least one fluid-conveying element extends at an angle ($\alpha$) with respect to a direction of the axis (a), and the angle ($\alpha$) is between 10° and 30°.

9. The internal combustion engine as claimed in claim 1, wherein an annular gap is formed between the housing element and the housing of the internal combustion engine, and the at least one fluid-conveying element is arranged to convey fluid through the annular gap.

10. The internal combustion engine as claimed in claim 9, wherein a fluid outflow opening is adjacent to the annular gap, and the at least one fluid-conveying element is arranged to convey fluid to the fluid outflow opening.

* * * * *